US008065980B2

(12) United States Patent
Dahl et al.

(10) Patent No.: US 8,065,980 B2
(45) Date of Patent: Nov. 29, 2011

(54) COOLANT SYSTEM

(75) Inventors: Erik Dahl, Göteborg (SE); Katarina Jemt, Göteborg (SE)

(73) Assignee: Volvo Lastvagnar AB, Gothenburg (SE)

( * ) Notice: Subject to any disclaimer, the term of this patent is extended or adjusted under 35 U.S.C. 154(b) by 100 days.

(21) Appl. No.: 12/522,425

(22) PCT Filed: Feb. 8, 2008

(86) PCT No.: PCT/SE2008/000109

§ 371 (c)(1),
(2), (4) Date: Jul. 8, 2009

(87) PCT Pub. No.: WO2008/097166

PCT Pub. Date: Aug. 14, 2008

(65) Prior Publication Data

US 2010/0031901 A1 Feb. 11, 2010

(30) Foreign Application Priority Data

Feb. 9, 2007 (SE) ..... 0700341

(51) Int. Cl.
*F01P 11/20* (2006.01)

(52) U.S. Cl. ..... 123/41.5; 123/41.54; 123/41.01

(58) Field of Classification Search ..... 123/41.01, 123/41.08, 41.1, 41.15, 41.44, 41.5, 41.54, 123/447, 467, 41.05, 41.51, 41.55; 138/30
See application file for complete search history.

(56) References Cited

U.S. PATENT DOCUMENTS

| | | | | |
|---|---|---|---|---|
| 3,256,868 | A * | 6/1966 | Gratzmuller | 123/41.44 |
| 4,784,181 | A * | 11/1988 | Hilverdink | 138/30 |
| 4,836,168 | A * | 6/1989 | Polster et al. | 123/41.5 |
| 5,836,269 | A * | 11/1998 | Schneider | 123/41.1 |
| 6,532,910 | B2 * | 3/2003 | Langervik | 123/41.08 |
| 6,666,175 | B2 | 12/2003 | Wand et al. | |
| 7,152,555 | B2 * | 12/2006 | Langervik | 123/41.08 |
| 2004/0250795 | A1 * | 12/2004 | Stroia et al. | 123/447 |
| 2005/0061264 | A1 | 3/2005 | Langervik | |

FOREIGN PATENT DOCUMENTS

| | | | |
|---|---|---|---|
| GB | 931087 | A | 7/1963 |
| GB | 1049441 | A | 11/1966 |

OTHER PUBLICATIONS

International Search Report for corresponding International Application PCT/SE2008/000109.
International Preliminary Report on Patentability for corresponding International Application PCT/SE2008/000109.

* cited by examiner

*Primary Examiner* — Noah Kamen
(74) *Attorney, Agent, or Firm* — WRB-IP LLP

(57) ABSTRACT

An engine cooling system is provided with a cooling circuit including a coolant pump for supplying an engine with a coolant and for circulating the coolant in the cooling circuit, and at least one heat exchanger for cooling said coolant downstream of the engine, wherein an expansion tank is connected to the cooling circuit upstream of the coolant pump. The cooling system is pressurized by a pressure regulating arrangement arranged to pressurize coolant supplied to the cooling circuit from the expansion tank during at least one predetermined operating mode of the engine and the expansion tank is closed to the ambient atmosphere during all normal engine operation modes.

24 Claims, 3 Drawing Sheets

COOLANT SYSTEM

BACKGROUND AND SUMMARY

This invention relates to engine cooling systems for vehicles, such as trucks, cars or buses, as well as stationary generator units, in particular to cooling systems provided with an expansion tank closed to the ambient atmosphere.

Engine cooling systems of this type often comprise an expansion tank. The expansion tank has many functions, among them to take care of the coolant expansion caused by increased coolant temperature, and to build up pressure in the system in order to pressurize the coolant pump suction side to avoid pump cavitation. For a truck or stationary engine installation with a coolant system containing 50-70 liters the coolant may expand around 2 liters from cold start to normal working temperature.

With expansion tanks used in vehicles today, a common solution is to use a controllable valve that may be set to open at a predetermined, relatively high pressure. The valve links the expansion volume inside the expansion tank with ambient air. This means that when the coolant is heated and expands, the air in the expansion tank is compressed until the pressure reaches the higher setting of the valve. The valve opens and releases air to the ambient atmosphere until the pressure has dropped to a desired pressure. This air is saturated with coolant, which is lost to the ambient air.

GB 1049771 A describes a system closed to the ambient comprising an air big enough that a pressure release valve is unnecessary. Such systems require big air volumes or sufficiently small coolant volumes.

Pressurized coolant systems are disclosed in US 20050061264 A1, U.S. Pat. No. 6,666,175 B2, and GB 931087 A.

The system of US 20050061264 A1 continuously adds new oxygenated air to the expansion tank (and the coolant) and continuously relief air which is saturated with vapor from the coolant through the relief valve to the atmosphere in order to control the pressure. U.S. Pat. No. 6,666,175 B2 discloses that the compressor supplies compressed air to the compensating tank.

During operating conditions when the temperature of the coolant is reduced, for example due to lower engine load or the cooling fan starting to engage, the coolant volume decreases and the pressure at the pump will be lowered. This will in turn reduce the pressure of the air in the expansion tank. When this pressure drops below a lower setting of the valve the valve opens, letting ambient air into the tank. This prevents the pressure in the cooling circuit from dropping below a predetermined pressure where cavitation may occur in the coolant pump.

It is desirable to solve at least one of the above discussed problems associated with prior art coolant systems, and particularly to provide a cooling system that can be controlled to quickly build up pressure at the coolant pump suction side when starting the engine, in order to avoid cavitation in the pump.

The invention relates, according to an aspect thereof, to an engine cooling system. The invention also relates, according to another aspect thereof, to a vehicle provided with such an engine cooling system.

The invention relates, according to an aspect thereof, to an engine cooling system with a cooling circuit comprising a coolant pump for supplying an engine with a coolant and for circulating the coolant in the cooling circuit and at least one heat exchanger for cooling said coolant downstream of the engine. In the cooling circuit, the pump will supply coolant to the engine, wherein the coolant is heated. Heated coolant may pass through a thermostat which, depending on the temperature of the coolant, will direct the coolant directly back to the pump or to a heat exchanger. The heat exchanger may be a radiator arranged to reduce the temperature of the coolant to a desired level. An expansion tank may be connected to the cooling circuit upstream of the coolant pump. The cooling system is pressurized by a pressure regulating means arranged to pressurize coolant supplied to the cooling circuit from the expansion tank during at least one predetermined operating mode of the engine and the expansion tank is closed to the ambient atmosphere during all normal engine operation modes. For instance, one such operating mode may be a cold start of the engine.

Pre-pressurizing the coolant supplied to the coolant pump reduces the risk of cavitation in said pump, due to a relatively low pressure in the suction conduit when the engine is started. Furthermore, by such an engine cooling system an even pressure without pressure peaks (high and low pressure) can be maintained. This is an advantage because pressure peaks may cause damage to the components of the coolant system. Introduction of ambient air into the system and loss of coolant to ambient air can be avoided, and thus oxidation of the coolant is prevented or counteracted.

According to a first embodiment, the pressure regulating means is located in the expansion tank and may be arranged to displace a volume of coolant in the expansion tank. When the pressure regulating means is pressurized, the pressure of the coolant in the expansion tank increases and the pressurized coolant will be forced into a suction conduit for the pump in the cooling circuit. The pressure regulating means may be a diaphragm or a similar suitable device arranged in the expansion tank. The system may be pressurized by increasing the volume of such a diaphragm by supplying it with compressed air or a similar suitable fluid. The system pressure is controlled by a suitable valve, such as a 3-way valve, that can either let air into the expansion tank or release it to the ambient air. The function of such a valve will be described in further detail below. The expansion tank may further contain a pressure actuated safety valve that will open to ambient air if the pressure in the tank increases above a predetermined maximum allowed pressure.

The volume of the expansion tank is preferably relatively large. A large expansion tank may contain a comparatively large diaphragm that may be used to create a desired pressurization of the coolant over a relatively large span of temperatures and coolant volumes. Also a relatively large expansion tank allows excess pressure to escape from the cooling circuit without causing an undesirably high pressure in the said tank. In a standard size tank, excess pressure spikes may cause a safety valve to open, which in turn would result in an undesired release of air and coolant to the ambient atmosphere. The volume of the expansion tank may be selected in the range 10-30%, preferably about 15%, of the total system volume. For the most common engine sizes, the volume of the expansion tank may be selected in the range 25-40 liters, depending factors such as the total cooling circuit volume and desired coolant pressure to be delivered to the suction conduit of the pump.

The pressure regulating means may be supplied with a pressurized fluid from an external source of pressure. The external source of pressure may be compressed air from a tank or compressor adjacent the engine or on a vehicle on which the engine is mounted. The source of compressed air could for example be supplied by an existing brake compressor in the vehicle or from an air compressor in a supercharged engine. Other suitable pressure sources may be pressurized hydraulic fluid from a pump on or adjacent the engine. Such a compressor or pump may be driven by the engine or a similar suitable source of power.

As the pressurized fluid is contained in a volume separated from the coolant, the fluid and the coolant are maintained in a non-contacting relationship to avoid contamination of the coolant. The fact that the cooling system is not directly connected to ambient air means that no coolant will be lost to the ambient air, and that no air that can oxidize the coolant will be introduced in the cooling system.

In a first example of the first embodiment, the expansion chamber may be located on the heat exchanger upstream of the coolant pump. For instance, if an upper section of the radiator is the highest located point of the cooling circuit, then the expansion tank may be mounted on or adjacent the upper section of said radiator. In this example, the expansion tank will also act as a deaeration chamber, wherein gas bubbles may be removed from the coolant.

In a second example of the first embodiment, the cooling system may comprise a separate deaeration chamber located at the highest point of the coolant system upstream of the coolant pump. The deaeration chamber may be mounted on the heat exchanger or radiator arranged to cool the coolant. The volume of the deaeration chamber may be relatively small and is mainly used to deaerate the system and to provide a location for filling coolant. For instance, when using an expansion tank with a volume of about 30 liters, the volume of the deaeration chamber may be in the range of 0.5 liters. However, even when using a large expansion tank with a volume around 40 liters, the volume of the deaeration chamber should preferably not exceed 5 liters. Similar to the first example, the gas may escape to the deaeration chamber through conduits connected to the thermostat and the upper tank of the radiator. A lower section of the deaeration chamber is connected to the suction conduit of the pump, in order to provide a static fill for the cooling circuit. An upper section of the deaeration chamber is in turn connected to a lower section of the expansion tank. This allows excess pressure to escape the cooling circuit by passing from the deaeration chamber into the expansion tank. Also, pressurized fluid may be forced from the expansion tank, through the deaeration chamber and into the suction conduit of the pump, in order to allow pressurization of the coolant supplied to the pump.

By providing the deaeration chamber on or adjacent the upper section of the radiator, the expansion chamber may be placed remote from the radiator. This allows the expansion tank to be placed in any suitable location on the truck, for example on the frame or chassis of a vehicle. Locating the expansion tank on the frame or chassis of the vehicle also adds to the packaging flexibility of the expansion tank. The smaller deaeration chamber can more easily be packaged on top of the cooling package, or radiator and the larger expansion tank can be placed in any suitable location. Furthermore, the larger expansion volume allows the same parts to be used on a wider range of installations.

As stated above, in connection with the first and second examples, the pressure regulating means may be connected to a source of fluid pressure via a controllable valve. The valve may be a pressure controlled valve that can be controlled by the pressure in the expansion tank. The valve may be a pressure controlled valve actuated directly by the pressure in the expansion tank, or a solenoid valve actuated on the basis of a signal from a pressure sensor in the tank.

The cooling system pressure may preferably, but not necessarily, be controlled by a pressure actuated 3-way valve. During start-up of the engine the valve may be arranged in an open position, in order to pressurize a diaphragm in the expansion tank to a predetermined pressure using a source of pressure. The valve may be maintained in a first open position as long as the pressure in the expansion tank is less than a predetermined pressure setting for the valve. When the pressure in the cooling circuit and the expansion tank reaches the set pressure for the valve, the valve will move to a closed position in order to maintain this pressure. The pressure setting for the valve may be a substantially fixed pressure or a range comprising an upper and a lower limit at which limits the valve is arranged to switch. During normal operation of the engine after start-up, the valve is controlled by the pressure in the expansion tank to maintain a predetermined pressure in the expansion tank and the cooling circuit. If a pressure spike, higher than the desired set pressure, should occur in the cooling circuit, the increased pressure may act on the valve to move it to a second open position to release pressure from the diaphragm. Should the cooling circuit experience a pressure cycling relative to the pre-set pressure for the valve, the valve may be used to counteract this condition. During each pressure drop the valve may be moved to the first open position to supply pressure to the diaphragm, while a subsequent increase in pressure may cause the valve to be moved to the second open position to release pressure from the diaphragm.

The expansion tank may also be provided with a safety valve. The safety valve may be set to release a relatively high excess pressure to the atmosphere. The valve release pressure is preferably set at a level that will maintain the cooling system in a closed state during all normal operating conditions. The valve should only open when there is a risk of damaging components in the cooling system. The safety valve is preferably, but not necessarily, a pressure controlled 2-way valve. The valve is normally maintained in a closed position, but may open at a predetermined set pressure to release excess pressure from the expansion tank.

According to a second embodiment, the pressure regulating means may be located in a supply conduit connecting the expansion tank to the cooling circuit system upstream of the coolant pump, hereinafter referred to as the main coolant pump. The cooling system may comprise a separate deaeration chamber located at the highest point of the coolant system upstream of the main coolant pump. The deaeration chamber may be mounted on the heat exchanger or radiator arranged to cool the coolant. The volume of the deaeration chamber may be relatively small and is mainly used to deaerate the system and to provide a location for filling coolant. For instance, when using an expansion tank with a volume of about 30 liters, the volume of the deaeration chamber may be in the range of 0.5 liters. However, even when using a large expansion tank with a volume around 40 liters, the volume of the deaeration chamber should preferably not exceed 5 liters. Any gas present in the coolant may escape to the deaeration chamber through conduits connected to the thermostat and the upper tank of the radiator. A lower section of the deaeration chamber is connected to the suction conduit of the pump, in order to provide a static fill for the cooling circuit. An upper section of the deaeration chamber is in turn connected to the expansion tank. In this embodiment the cooling system may comprise a deaeration chamber located upstream of the main coolant pump. The expansion tank is connected to the deaeration chamber via a conduit provided with a controllable valve. The controllable valve is preferably, but not necessarily, a pressure controlled 2-way valve. The valve can be spring loaded towards a closed position, but may open when the pressure in the main cooling circuit exceeds a predetermined set pressure to release excess pressure from the deaeration chamber to the expansion tank, in order to maintain a desired pressure in the main cooling circuit. When the engine is running a pre-pressurizing pump may be operated continuously to supply the main circuit with pressurized coolant. The pressure in the main circuit is maintained and controlled by the pressure controlled valve located between the deaeration tank and the expansion tank.

By providing the deaeration chamber on or adjacent the upper section of the radiator, the expansion chamber may be placed remote from the radiator. This allows the expansion tank to be placed in any suitable location on the truck, for example on the frame or chassis of a vehicle. Locating the expansion tank on the frame or chassis of the vehicle also adds to the packaging flexibility of the expansion tank. The smaller deaeration chamber can more easily be packaged on top of the cooling package, or radiator and the larger expansion tank can be placed in any suitable location. Furthermore, the larger expansion volume allows the same parts to be used on a wider range of installations.

As in the first embodiment above, the volume of the expansion tank is preferably relatively large. A large expansion tank may be used to allow a desired pressurization of the coolant over a relatively large span of temperatures and coolant volumes, without having to vent the tank to the ambient atmosphere during periods of relatively high pressure in the system. The volume of the expansion tank may be selected in the range 10-30% of the total volume of the cooling system. The volume of the expansion tank may be selected in the range 25-40 liters, depending factors such as the total cooling circuit volume and desired coolant pressure to be delivered to the suction conduit of the pump.

According to the second main embodiment of the invention, the pre-pressurized coolant is supplied by the pre-pressurizing coolant pump as previously described, or alternatively by any other suitable pressure regulating means, such as for example an injector device. During certain operating conditions, such as a start-up of the engine, the pump may draw coolant from the expansion tank and supply pre-pressurized coolant to the main coolant pump in the cooling circuit. This reduces the risk of cavitation in the main coolant pump, due to a relatively low pressure in the suction conduit when the engine is started.

The system pressure may be controlled by the pressure controlled valve using a signal from a pressure sensor located at a suitable position in the cooling circuit, such as immediately upstream of the main coolant pump. During start-up of the engine the pre-pressurizing coolant pump may be arranged to supply coolant from the expansion tank at a predetermined pressure to the main coolant pump. When the pressure in the cooling circuit and the expansion tank reaches the set pressure the pre-pressurizing coolant pump is continuously operated to assist the main coolant pump in maintaining a predetermined pressure in the cooling circuit. During normal operation of the engine after start-up, the pressure controlled valve is opened or closed to maintain this pressure. If a pressure spike, higher than the desired set pressure, should occur in the cooling circuit, the increased pressure may act on the controllable valve to move it to an open position. Excess pressure will then be released from the deaeration chamber to the expansion tank. Should the cooling circuit experience a pressure cycling relative to the pre-set pressure for the cooling circuit, the pre-pressurizing coolant pump and the controllable valve may be used to assist the main coolant pump in counteracting this condition. During each pressure drop the pre-pressurizing coolant pump will supply pressure to the suction conduit to counteract this condition, while a subsequent increase in pressure may cause the controllable valve to be moved to its open position to release pressure to the expansion tank.

Alternatively, the pre-pressurizing coolant pump may be operated as long as the pressure in the suction conduit is less than a predetermined pressure. When the pressure in the cooling circuit and the expansion tank reaches the set pressure the pre-pressurizing coolant pump is deactivated, where after the main coolant pump will maintain this pressure. During normal operation of the engine after start-up, the pre-pressurizing coolant pump may be controlled by a sensed pressure in the expansion tank to assist the main coolant pump in maintaining a predetermined pressure in the cooling circuit. If a pressure spike, higher than the desired set pressure, should occur in the cooling circuit, the increased pressure may act on the controllable valve to move it to an open position. Excess pressure will then be released from the deaeration chamber to the expansion tank. Should the cooling circuit experience a pressure cycling relative to the pre-set pressure for the cooling circuit, the pre-pressurizing coolant pump may be used to assist the main coolant pump in counteracting this condition. During each pressure drop the pre-pressurizing coolant pump may, if necessary, be actuated to supply pressure to the suction conduit, while a subsequent increase in pressure may cause the controllable valve to be moved to its open position to release pressure to the expansion tank.

The volume of the expansion tank is preferably relatively large. A large expansion tank may contain a comparatively large diaphragm that may be used to create a desired pressurization of the coolant over a relatively large span of temperatures and coolant volumes. Also a relatively large expansion tank allows excess pressure to escape form the cooling circuit without causing an undesirably high pressure in the said tank. In a standard size tank, excess pressure spikes may cause a safety valve to open, which in turn would result in an undesired release of air and coolant to the ambient atmosphere. The volume of the expansion tank may be selected in the range 25-40 liters, depending factors such as the total cooling circuit volume and desired coolant pressure to be delivered to the suction conduit of the pump.

The expansion tank may also be provided with a safety valve. The safety valve may be set to release a relatively high excess pressure to the atmosphere. The valve release pressure is preferably set at a level that will maintain the cooling system in a closed state during all normal operating conditions. The valve should only open when there is a risk of damaging components in the cooling system. The safety valve is preferably, but not necessarily, a pressure controlled 2-way valve. The valve is normally maintained in a closed position, but may open at a predetermined set pressure to release excess pressure from the expansion tank. An additional sensor can be located in the expansion tank for monitoring the pressure therein and/or to control a solenoid operated safety valve.

The invention further relates to a vehicle provided with a cooling system as described for the first and second embodiments above. Hence the vehicle may be provided with a pressure regulating means arranged to displace the coolant in the expansion tank, by means of a diaphragm or similar, using a source of fluid pressure via a controllable valve. The pressure source may be an air tank, an air compressor or a compressor in a supercharger located on vehicle.

Alternatively the vehicle may be provided with a pressure regulating means for maintaining a predetermined pressure in the main coolant pump, as described above. The pressure regulating means may be a controllable pump or an injector arranged to supply coolant under pressure to the main coolant pump in the cooling circuit. This arrangement may be used to prevent cavitation in the main coolant pump during certain operating conditions, such as a start-up of the engine.

The pressurized cooling systems described in the above embodiments provide a cooling system that can be controlled to quickly build up pressure at the coolant pump suction side when starting the engine, in order to avoid cavitation in the pump. The pressurized cooling systems according to the invention also provides means for maintaining an even pressure that is high enough to avoid pump cavitation during operation of the engine, even when the coolant has cooled down. The cooling systems also make it possible to avoid pressure peaks (high and low pressure) and pressure cycling that may damage the components in the coolant system. It is also desirable to avoid introducing ambient air into the system, which air may oxidize the coolant (ageing of coolant), and to avoid loosing coolant to ambient air. The invention will therefore have a positive effect on the life time of the components in the coolant system and of the coolant and the efficiency of the coolant pump. Examples of additional advantages with the solutions according to the invention are that coolant top off intervals should be less frequent since there is no continuous loss of coolant, which is also beneficial for the environment. Since the expansion tank has a larger expansion volume which is less sensitive to small leaks. With the expansion tank mounted on the chassis, the tank is easier to service and facilitates reading of the coolant level.

BRIEF DESCRIPTION OF DRAWINGS

In the following text, the invention will be described in detail with reference to the attached drawings. These schematic drawings are used for illustration only and do not in any way limit the scope of the invention. In the drawings.

DETAILED DESCRIPTION

Figure 1:
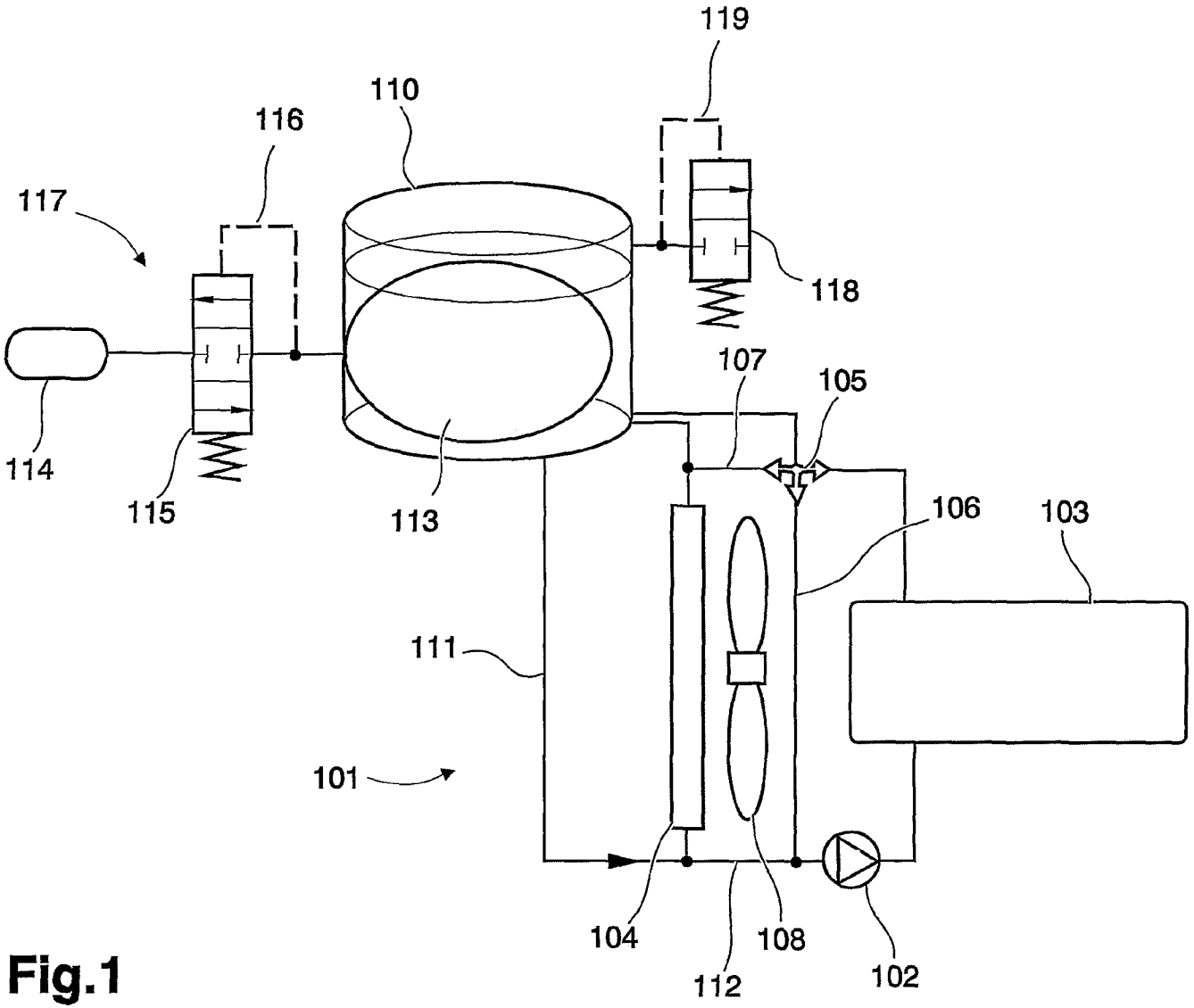
FIG. 1 shows a pressurized cooling system according to a first embodiment of the invention.

FIG. 1 shows a pressurized cooling system according to a first embodiment of the invention.

The engine cooling system comprises a cooling circuit 101 with a coolant pump 102 for supplying an engine 103 with a coolant and for circulating the coolant in the cooling circuit 101. A radiator 104 is provided for cooling said coolant downstream of the engine 103. In the cooling circuit, the pump 102 will supply coolant to the engine 103, wherein the coolant is heated. Heated coolant will pass through a thermostat 105 which, depending on the temperature of the coolant, will direct the coolant directly back to the pump 102 through a first conduit 106, or indirectly via the radiator 104 through a second conduit 107. The radiator 104 is arranged to reduce the temperature of the coolant to a desired level, which temperature reduction is assisted by a cooling fan 108. The cooling system can also be arranged to cool a charge air cooler (not shown) located adjacent the radiator 104. An expansion tank 110 is connected to the cooling circuit 101 via a supply conduit 111 connected to a third conduit 112 connecting the outlet of the radiator 104 and the coolant pump 102. The supply conduit 111 is connected to the expansion tank 110 adjacent the bottom thereof. The expansion tank 110 and the supply conduit 111 provide a static filling means for the cooling circuit, wherein fluctuation in coolant volume is taken up by the expansion tank 110. The third conduit 112 is also referred to as the suction conduit. In this example the expansion tank 110 is placed on or adjacent the upper part of the radiator 104 and is in fluid connection with both the radiator 104 and the thermostat 105. This allows air and excess pressure to escape from the cooling circuit 101 to the expansion tank 110. In this way the expansion tank 110 will also act as a deaeration chamber, wherein gas bubbles may be removed from the coolant. The cooling system is pressurized by a pressure regulating means comprising a schematically indicated diaphragm 113 arranged to pressurize coolant supplied to the cooling circuit from the expansion tank 110 during at least one predetermined operating mode of the engine. The expansion tank 110 is closed to the ambient atmosphere during all normal engine operation modes. One such operating mode can be a cold start of the engine. Pre-pressurizing the coolant supplied to the coolant pump reduces the risk of cavitation in said pump, due to a relatively low pressure in the suction conduit when the engine is started.

The diaphragm 113 is supplied with a pressurized fluid from an external source of pressure. In this example, the external source of pressure is a brake compressor 114 in the vehicle, but compressed air may be sourced from any suitable compressed air tank or compressor adjacent the engine or on a vehicle on which the engine is mounted.

The cooling system pressure is controlled by a pressure actuated 3-way valve 115 connected between the compressor 114 and the diaphragm 113.

During start-up of the engine the valve 115 is arranged in an open position, in order to pressurize the diaphragm 113 in the expansion tank 110 to a predetermined pressure using pressure supplied from the compressor 114. The valve 115 is maintained in a first open position as long as the pressure in the expansion tank 110 is less than a predetermined pressure setting for the valve 115. The pressure setting for the valve 115 can be a substantially fixed pressure or a range comprising an upper and a lower limit at which limits the valve 115 is arranged to switch. When the pressure in the cooling circuit and the expansion tank 110 is increased to reach the set pressure for the valve 115, the valve 115 will move to a closed position in order to maintain the current pressure in the diaphragm 113. During normal operation of the engine after start-up, the valve 115 is controlled by the pressure in the expansion tank 110 via a pilot conduit 116 that allows the pressure in the diaphragm to act on one end of the valve 115. As long as the pressure in the cooling circuit is within a predetermined pressure range, the valve 115 is closed to maintain a predetermined pressure in the expansion tank 110.

If a pressure spike, higher than the desired set pressure, should occur in the cooling circuit, an increased pressure can reach the expansion tank 110 through the supply conduit 111 or through the conduits connecting the radiator 104 and the thermostat 105 to the expansion tank 110. The increased pressure in the expansion tank 110 acts on the diaphragm 113, which causes an increase of the pressure in the pilot conduit 116. The valve 115 is then moved to a second open position to release pressure from the diaphragm 113 to the ambient atmosphere, at 117. Should the cooling circuit experience a pressure cycling relative to the pre-set pressure for the valve, the valve 115 is used to counteract this condition. During each pressure drop the valve 115 is moved to the first open position to supply pressure to the diaphragm 113, while a subsequent increase in pressure causes the valve 115 to be moved to the second open position to release pressure from the diaphragm 113.

Figure 2:
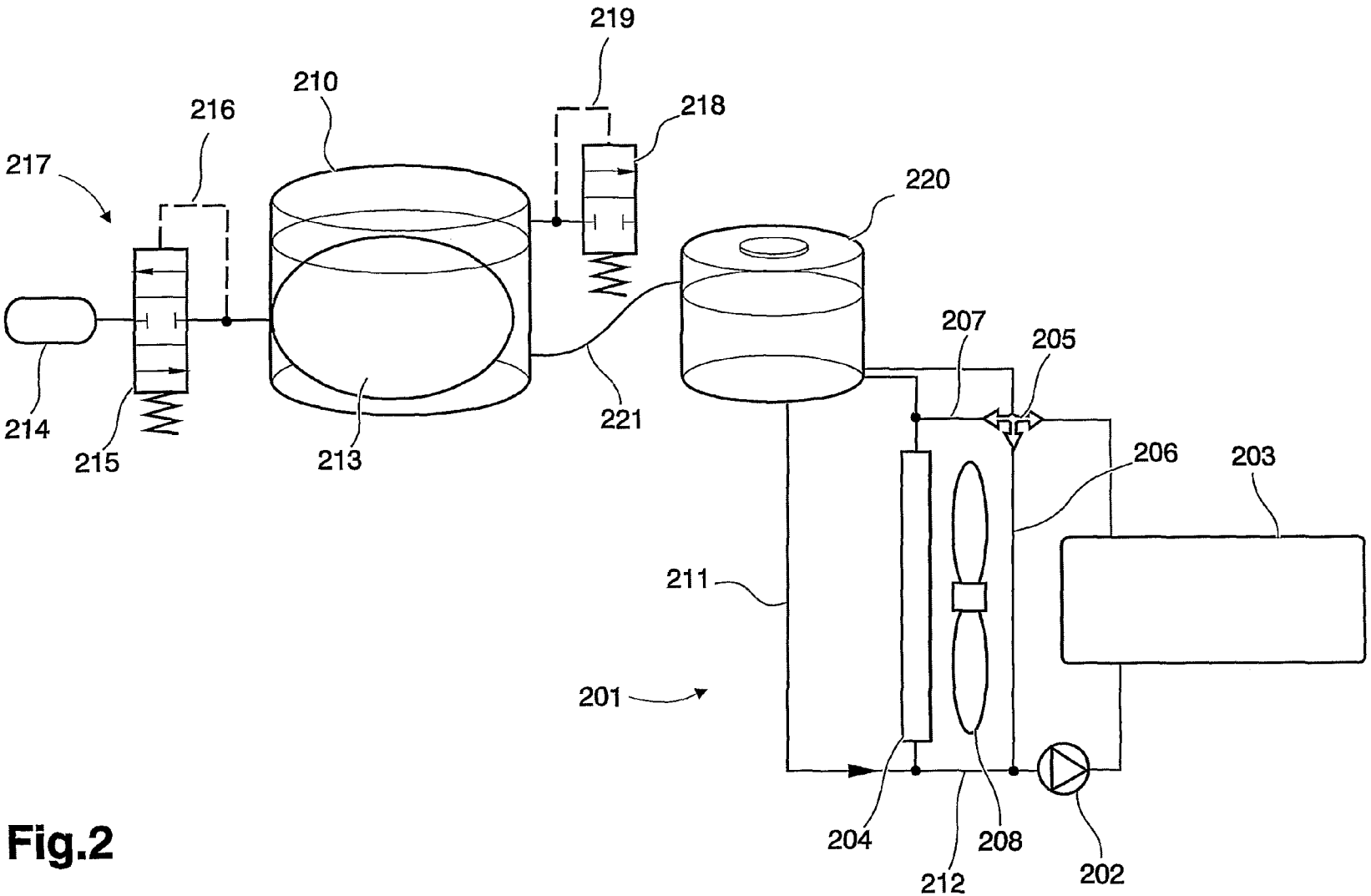
FIG. 2 shows a pressurized cooling system according to an alternative first embodiment of the invention.

The expansion tank 110 is further provided with a safety valve 118. The safety valve 118 is set to release a relatively high excess pressure to the atmosphere. The safety valve 18 release pressure is preferably set at a level that will maintain the cooling system in a closed state during all normal operating conditions. The safety valve 118 should only open when there is a risk of damaging components in the cooling system. The safety valve 118 is a pressure controlled 2-way valve. The safety valve 118 is connected to an upper section of the expansion tank and is normally maintained in a closed position, as shown in FIG. 1. At a predetermined set pressure in a pilot conduit 119 acting on one end of the safety valve 118, the safety valve is opened to release excess pressure from the expansion tank 110. FIG. 2 shows a pressurized cooling system according to an alternative first embodiment of the invention. As in the embodiment of FIG. 1, the engine cooling system comprises a cooling circuit 201 with a coolant pump 202 for supplying an engine 203 with a coolant and for circulating the coolant in the cooling circuit 201. A radiator 204 is provided for cooling said coolant downstream of the engine 203. In the cooling circuit, the pump 202 will supply coolant to the engine 203, wherein the coolant is heated. Heated coolant will pass through a thermostat 205 which, depending on the temperature of the coolant, will direct the coolant directly back to the pump 202 through a first conduit 206, or indirectly via the radiator 204 through a second conduit 207. The radiator 204 is arranged to reduce the temperature of the coolant to a desired level, which temperature reduction is assisted by a cooling fan 208. The cooling system can also be arranged to cool a charge air cooler (not shown) located adjacent the radiator 204. A deaeration chamber 220 is connected to the cooling circuit 201 via a supply conduit 211 connected to a third conduit 212 connecting the outlet of the radiator 204 and the coolant pump 202. The third conduit 212 is also referred to as the suction conduit. The deaeration chamber 220 and the supply conduit 211 provide a static filling means for the cooling circuit, wherein fluctuation in coolant volume is taken up by the deaeration chamber 220 and an expansion tank 210. The supply conduit 211 is connected to the expansion tank 210 adjacent the bottom thereof. In this example the deaeration chamber 220 is placed on or adjacent the upper part of the radiator 204 and is in fluid connection with both the radiator 204 and the thermostat 205. The expansion tank 210 is mounted at a suitable location on the vehicle chassis (not shown). The deaeration chamber 220 allows gas bubbles may be removed from the coolant and is also provided with a filler cap to allow refilling of coolant. The deaeration chamber 220 and an expansion tank 210 are connected by a fourth conduit 221 that allows excess pressure to escape from the cooling circuit 201 and the deaeration chamber 220 to the expansion tank 210. The fourth conduit 221 is connected to the deaeration chamber 220 at a position that is normally over the coolant level. On the other hand, the fourth conduit 221 is connected to the expansion tank 210 at a position that is normally below the coolant level. The cooling system is pressurized by a pressure regulating means comprising a schematically indicated diaphragm 213 arranged to pressurize coolant supplied to the cooling circuit 201 from the expansion tank 210 during at least one predetermined operating mode of the engine. The expansion tank 210 is closed to the ambient atmosphere during all normal engine operation modes. One such operating mode can be a cold start of the engine. Pre-pressurizing the coolant supplied to the coolant pump reduces the risk of cavitation in said pump, due to a relatively low pressure in the suction conduit 212 when the engine 203 is started.

The diaphragm 213 is supplied with a pressurized fluid from an external source of pressure. In this example, the external source of pressure is a brake compressor 214 in the vehicle, but compressed air may be sourced from any suitable compressed air tank or compressor adjacent the engine or on a vehicle on which the engine is mounted.

The cooling system pressure is controlled by a pressure actuated 3-way valve 215 connected between the compressor 214 and the diaphragm 213.

During start-up of the engine the valve 215 is arranged in an open position, in order to pressurize the diaphragm 213 in the expansion tank 210 to a predetermined pressure using pressure supplied from the compressor 214. The valve 215 is maintained in a first open position as long as the pressure in the expansion tank 210 is less than a predetermined pressure setting for the valve 215. The pressure setting for the valve 215 can be a substantially fixed pressure or a range comprising an upper and a lower limit at which limits the valve 215 is arranged to switch. When the pressure in the cooling circuit and the expansion tank 210 is increased to reach the set pressure for the valve 215, the valve 215 will move to a closed position in order to maintain the current pressure in the diaphragm 213. During normal operation of the engine after start-up, the valve 215 is controlled by the pressure in the expansion tank 210 via a pilot conduit 216 that allows the pressure in the diaphragm to act on one end of the valve 215. As long as the pressure in the cooling circuit is within a predetermined pressure range, the valve 215 is closed to maintain a predetermined pressure in the expansion tank 210.

If a pressure spike, higher than the desired set pressure, should occur in the cooling circuit, an increased pressure can escape through the supply conduit 211 or through the conduits connecting the radiator 204 and the thermostat 205, via the deaeration chamber 220 and the fourth conduit 221 and into the expansion tank 210. The increased pressure in the expansion tank 210 acts on the diaphragm 213, which causes an increase of the pressure in the pilot conduit 216. The valve 215 is then moved to a second open position to release pressure from the diaphragm 213 to the ambient atmosphere, at 217. Should the cooling circuit experience a pressure cycling relative to the preset pressure for the valve, the valve 215 is used to counteract this condition. During each pressure drop the valve 215 is moved to the first open position to supply pressure to the diaphragm 213, while a subsequent increase in pressure causes the valve 215 to be moved to the second open position to release pressure from the diaphragm 213.

Figure 3:
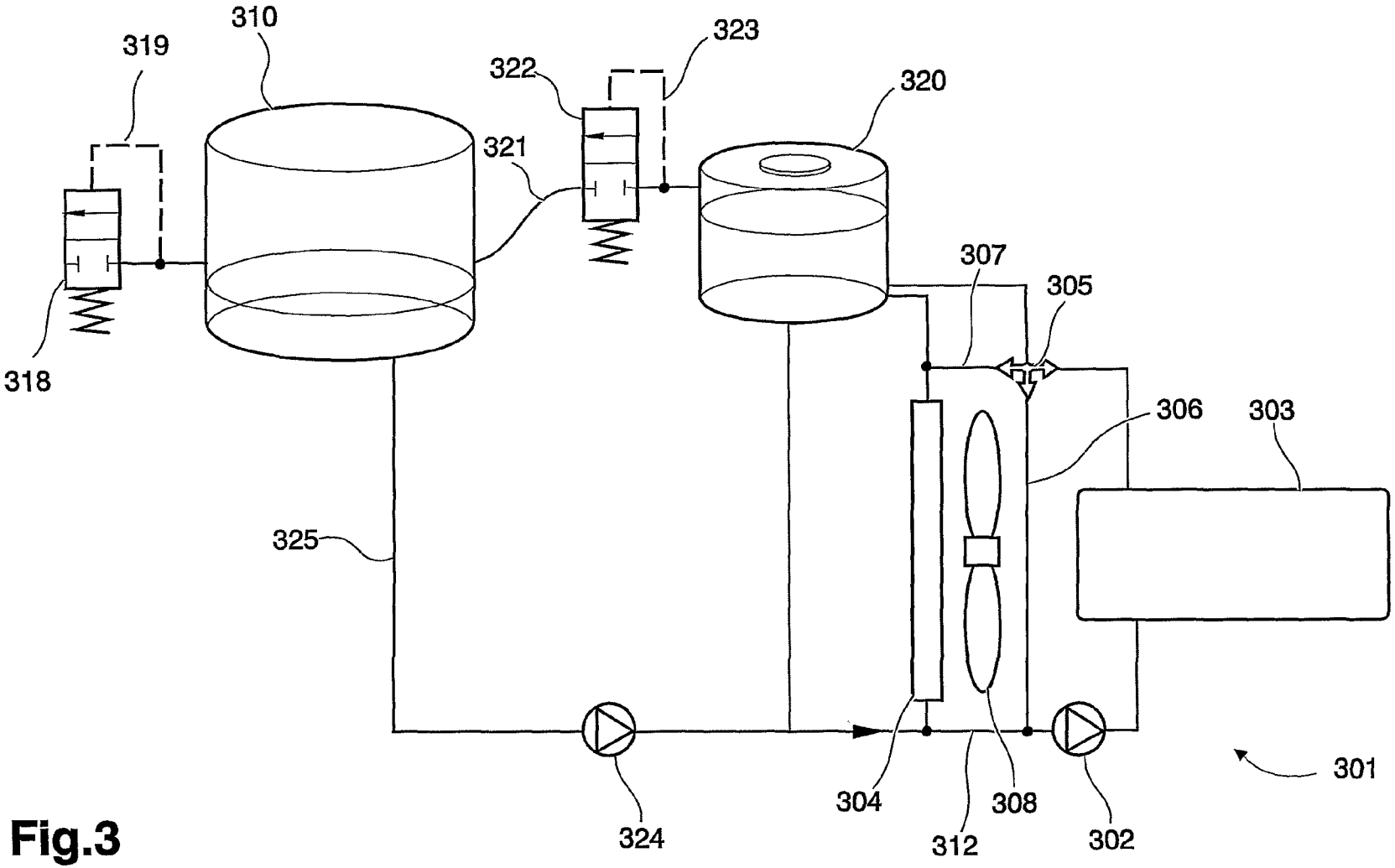
FIG. 3 shows a pressurized cooling system according to a second embodiment of the invention.

The expansion tank 210 is further provided with a safety valve 218. The safety valve 218 is set to release a relatively high excess pressure to the atmosphere. The safety valve 28 release pressure is preferably set at a level that will maintain the cooling system in a closed state during all normal operating conditions. The safety valve 218 should only open when there is a risk of damaging components in the cooling system. The safety valve 218 is a pressure controlled 2-way valve. The safety valve 218 is connected to an upper section of the expansion tank and is normally maintained in a closed position, as shown in FIG. 2. At a predetermined set pressure in a pilot conduit 219 acting on one end of the safety valve 218, the safety valve is opened to release excess pressure from the expansion tank 210. FIG. 3 shows a pressurized cooling system according to a second embodiment of the invention. As in the embodiment of FIG. 2, the engine cooling system comprises a cooling circuit 301 with a coolant pump 302 for supplying an engine 303 with a coolant and for circulating the coolant in the cooling circuit 301. A radiator 304 is provided for cooling said coolant downstream of the engine 303. In the cooling circuit, the pump 302 will supply coolant to the engine 303, wherein the coolant is heated. Heated coolant will pass through a thermostat 305 which, depending on the temperature of the coolant, will direct the coolant directly back to the pump 302 through a first conduit 306, or indirectly via the radiator 304 through a second conduit 307. The radiator 304 is arranged to reduce the temperature of the coolant to a desired level, which temperature reduction is assisted by a cooling fan 308. The cooling system can also be arranged to cool a charge air cooler (not shown) located adjacent the radiator 304. A deaeration chamber 320 is connected to the cooling circuit 301 via a supply conduit 311 connected to a third conduit 312 connecting the outlet of the radiator 304 and the coolant pump 302. The third conduit 312 is also referred to as the suction conduit. The deaeration chamber 320 and the supply conduit 311 provide a static filling means for the cooling circuit, wherein fluctuation in coolant volume is taken up by the deaeration chamber 320 and an expansion tank 310. The supply conduit 311 is connected to the expansion tank 310 adjacent the bottom thereof. In this example the deaeration chamber 320 is placed on or adjacent the upper part of the radiator 304 and is in fluid connection with both the radiator 304 and the thermostat 305. The expansion tank 310 is mounted at a suitable location on the vehicle chassis (not shown). The deaeration chamber 320 allows gas bubbles may be removed from the coolant and is also provided with a filler cap to allow refilling of coolant. The deaeration chamber 320 and an expansion tank 310 are connected by a fourth conduit 321 that allows excess pressure to escape from the cooling circuit 301 and the deaeration chamber 320 to the expansion tank 310. The fourth conduit 321 is connected to the expansion tank 310 and the deaeration chamber 320 at a position that is normally over the coolant level in the respective tank and chamber. The fourth conduit 321 is further provided with a controllable valve 322. In this example, the controllable valve 322 is a pressure controlled 2-way valve. The valve 322 is spring loaded towards a closed position and is opened at a predetermined set pressure to release excess pressure from the deaeration chamber 320 to the expansion tank 310. Excess pressure from the deaeration chamber 320 will act on one end of the valve 322 via a pilot conduit 323 in order to open the valve 322. The expansion tank 310 is closed to the ambient atmosphere during all normal engine operation modes. The expansion tank 310 can be provided with a safety valve 318. The safety valve 318 is then set to release a relatively high excess pressure to the atmosphere. The safety valve 318 release pressure is preferably set at a level that will maintain the cooling system in a closed state during all normal operating conditions. The safety valve 318 should only open when there is a risk of damaging components in the cooling system. The safety valve 318 may be a pressure controlled 2-way valve. The safety valve 318 is connected to the expansion tank and is normally maintained in a closed position, as shown in FIG. 3. At a predetermined set pressure in a pilot conduit 319 acting on one end of the safety valve 318, the safety valve is opened to release excess pressure from the expansion tank 310.

In the example shown in FIG. 3 the cooling system is continuously pressurized by the second coolant pump 324, which is arranged to pressurize coolant supplied to the suction conduit 312 of the cooling circuit 301 from the expansion tank 310 during all normal operating modes of the engine. The second coolant pump 324 is arranged in a second supply conduit 325 connecting the expansion tank 310 to the first supply conduit 311 and the suction conduit 312 for the first coolant pump 302.

The system pressure is controlled by the valve 322 using a signal from a pressure sensor (not shown) located at a suitable position in the cooling circuit, such as immediately upstream of the first coolant pump 302. The valve 322 can also be controlled by the pressure in the deaeration chamber 320. When the pressure in the main cooling circuit 301 reaches the set pressure the pre-pressurizing coolant pump 324 can be deactivated, where after the first coolant pump 302 will maintain this pressure. During normal operation of the engine 303 after start-up, the second coolant pump 324 is controlled by a sensed pressure in the suction conduit 312 to assist the first coolant pump 302 in maintaining a predetermined pressure in the cooling circuit. If a pressure spike, higher than the desired set pressure, should occur in the cooling circuit, the increased pressure may act on the controllable valve 322 to move it to an open position. Excess pressure will then be released from the deaeration chamber 320 to the expansion tank 310. Should the cooling circuit 301 experience a pressure cycling relative to the predetermined pressure for the cooling circuit 301, the pre-pressurizing second coolant pump 324 may be used to assist the first coolant pump 302 in counteracting this condition. During each pressure drop the pre-pressurizing second coolant pump 324 is, if required, actuated to supply pressure to the suction conduit 312, while a subsequent increase in pressure will cause the controllable valve 322 to be moved to its open position to release pressure to the expansion tank 310.

The invention is not limited to the above embodiments, but may be varied freely within the scope of the appended claims.

The invention claimed is:

1. Engine cooling system with a cooling circuit comprising a coolant pump for supplying an engine with a coolant and for circulating the coolant in the cooling circuit, and at least one heat exchanger for cooling the coolant downstream of the engine, wherein an expansion tank is connected to the cooling circuit upstream of the coolant pump, wherein the cooling system is pressurized by pressure regulating means arranged to pressurize coolant supplied to the cooling circuit from the expansion tank during at least one predetermined operating mode of the engine and the expansion tank is closed to the ambient atmosphere during all normal engine operation modes.

2. Engine cooling system according to claim 1, wherein the pressure regulating means is located in the expansion tank.

3. Engine cooling system according to claim 2, wherein the pressure regulating means is arranged to displace the coolant in the expansion tank.

4. Engine cooling system according to claim 3, wherein the pressure regulating means is supplied with a pressurized fluid from an external source of pressure.

5. Engine cooling system according to claim 4, wherein the pressurized fluid is contained in a volume separated from the coolant.

6. Engine cooling system according to claim 5, wherein the pressure regulating means comprises a diaphragm.

7. Engine cooling system according to claim 4, wherein the cooling system further comprises a deaeration chamber located upstream of the coolant pump.

8. Engine cooling system according to claim 7, wherein the expansion tank is connected to the deaeration chamber.

9. Engine cooling system according to claim 2, wherein the pressure regulating means is connected to a source of fluid pressure via a controllable valve.

10. Engine cooling system according to claim 9, wherein the coolant and the fluid from the source of fluid pressure are maintained in a non-contacting relationship.

11. Engine cooling system according to claim 9, wherein the valve is a pressure controlled valve.

12. Engine cooling system according to claim 11, wherein the valve is controlled by the pressure in the expansion tank.

13. Engine cooling system according to claim 9, wherein the valve is controllable to pressurize the expansion tank to a predetermined pressure during start-up of the engine.

14. Engine cooling system according to claim 9, wherein the valve is controllable to maintain a predetermined pressure in the expansion tank during normal operation of the engine.

15. Engine cooling system according to claim 1, wherein one operating mode is a start-up of the engine.

16. Engine cooling system according to claim 1, wherein the pressure regulating means is located in a supply conduit connecting the expansion tank to the cooling circuit.

17. Engine cooling system according to claim 16, wherein the cooling system further comprises a deaeration chamber located upstream of the coolant pump.

18. Engine cooling system according to claim 17, wherein the expansion tank is connected to the deaeration chamber via a controllable valve.

19. Engine cooling system according to claim 18, wherein the valve is controlled by the pressure in the deaeration chamber.

20. Engine cooling system according to claim 18, wherein the pressure regulating means is a pump.

21. Engine cooling system according to claim 18, wherein the pressure regulating means is an injector.

22. Engine cooling system according to claim 1, wherein the volume of the expansion tank is at least 10% of the total volume of the cooling system.

23. Engine cooling system according to claim 1, wherein the volume of the expansion tank is up to 30% of the total volume of the cooling system

24. A vehicle comprising an engine cooling system according to claim 1.

* * * * *